US006497209B1

(12) United States Patent
Karuppana et al.

(10) Patent No.: US 6,497,209 B1
(45) Date of Patent: Dec. 24, 2002

(54) SYSTEM AND METHOD FOR PROTECTING A CRANKING SUBSYSTEM

(75) Inventors: Samy V. Karuppana, Kent, WA (US); Aly Amirali Jetha, Seattle, WA (US); Jes Thomsen, Copenhagen (DK)

(73) Assignee: Intra International AB, Gothenburg (SE)

( * ) Notice: Subject to any disclaimer, the term of this patent is extended or adjusted under 35 U.S.C. 154(b) by 0 days.

(21) Appl. No.: 09/654,188

(22) Filed: Sep. 1, 2000

Related U.S. Application Data

(60) Provisional application No. 60/153,325, filed on Sep. 10, 1999.

(51) Int. Cl.[7] ..... F02N 11/08

(52) U.S. Cl. ..... 123/179.3; 307/10.7; 290/38 R

(58) Field of Search ..... 123/179.3, 179.25; 307/9.1, 10.1, 10.6, 10.7; 318/139; 290/38 C, 38 R, 34, 51

(56) References Cited

U.S. PATENT DOCUMENTS 3,646,354 A * 2/1972 Von Brimer ..... 307/10.7
5,198,698 A 3/1993 Paul et al. ..... 307/64
5,321,389 A * 6/1994 Meister ..... 307/10.7
5,349,931 A * 9/1994 Gottlieb et al. ..... 123/179.2
5,798,577 A 8/1998 Lesesky et al. ..... 307/10.7
5,838,136 A 11/1998 Waugh ..... 320/6
5,848,577 A * 12/1998 Sappe et al. ..... 123/179.3
5,871,858 A 2/1999 Thomsen et al. ..... 327/403
5,886,419 A * 3/1999 Saito et al. ..... 327/403
5,977,744 A * 11/1999 Williams et al. ..... 307/10.1
6,018,199 A * 1/2000 Shiroyama et al. ..... 320/104
6,023,137 A 2/2000 Kumar et al. ..... 318/254
6,150,793 A * 11/2000 Lesesky et al. ..... 123/179.3
6,363,899 B1 * 4/2002 Koelle et al. ..... 123/179.3
6,437,957 B1 * 8/2002 Karuppana et al. ..... 361/78

* cited by examiner

*Primary Examiner*—Tony M. Argenbright
*Assistant Examiner*—Hai Huynh
(74) *Attorney, Agent, or Firm*—Sawyer Law Group LLP

(57) ABSTRACT

A method and system for controlling power to a cranking subsystem in a device having a power source is disclosed. The cranking subsystem is coupled to an engine and a starter that allows a user to activate the cranking subsystem. The method and system include providing a switch and at least one controller. The switch is coupled between the power source and the cranking subsystem. The at least one controller is coupled with the switch and is for controlling the switch to be open or closed based on the starter being used to activate the cranking subsystem and at least one other criteria. The at least one other criteria is programmed into the controller.

22 Claims, 12 Drawing Sheets

SYSTEM AND METHOD FOR PROTECTING A CRANKING SUBSYSTEM

This application claims the benefit of provisional application Ser. No. 60/153,325, filed Sep. 10, 1999.

FIELD OF THE INVENTION

The present invention relates to systems which may have a limited power supply and more particularly to a method and system for providing intelligent power management in such as system which can protect the cranking subsystem of a device such as a truck tractor.

BACKGROUND OF THE INVENTION

Many systems utilize a power supply which may have a limited capacity. For example, truck tractors, boats, golf carts, and satellites may utilize a battery or other energy storage apparatus for DC electrical power. These devices may have a mechanism for recharging the battery, such as an alternator. However, on occasion these devices operate on the stored power from the battery. For example, a truck tractor typically includes an alternator for generating power, a battery for storing power, and various subsystems which may consume power. These power consumers include a cranking system; lights; computers; communication devices electronics for the engine, brakes, steering and other subsystems; and comfort devices such as heating cooling, ventilation, refrigeration, microwaves, and televisions. Many of the power consumers can operate on the stored power of the battery alone when the alternator is not generating power.

Breakdown of the electrical system can be the primary cause of failure for many of these devices, such as the tractor trailer. Even where the electrical system is less subject to malfunctions, breakdown of the electrical system can cause the device to be unable to function. Such a failure of the device may be expensive, both to repair and in other costs absorbed by the user. For example, a failure of the electrical system which drains the battery of a truck tractor may be costly not only because the truck tractor must be towed to another location and repaired, but also because time and perishable cargo may be lost. Consequently, the ability to predict, diagnose, and avoid such failures is desirable.

Mechanisms for avoiding such failure are disclosed in U.S. Pat. No. 5,871,858 by Thomsen et al. ("Thomsen") and U.S. Pat. No. 5,798,577 by Lesesky et al. ("Lesesky"). Thomsen and Lesesky treat one problem that has been diagnosed in devices such as a truck tractor, the problem of overcranking. Consequently, Thomsen discloses cutting off power to the cranking system of a truck tractor when the current flowing and time for which the current flows exceed a particular level. Similarly, Lesesky discloses cutting off power to the cranking system of a truck tractor when a user has provided a cranking signal for greater than a particular time. Furthermore, Thomsen treats the problem of theft using solid state switches controlled using a micro-computer and a code input by a user. Based on whether a code is provided to the system, whether the internal temperature of a switch is above a particular value, and whether a particular current has been provided for a particular time, Thomsen allows power to be provided to the cranking motor.

However, it would still be desirable to be capable of diagnosing impending failures, avoiding failures, providing power to consumers in a more optimal manner. Accordingly, what is needed is a system and method for providing intelligent power management. The present invention addresses such a need.

SUMMARY OF THE INVENTION

The present invention provides a method and system for controlling power to a cranking subsystem in a device having a power source. The cranking subsystem is coupled to an engine and a starter that allows a user to activate the cranking subsystem. The method and system include providing a switch and at least one controller. The switch is coupled between the power source and the cranking subsystem. The at least one controller is coupled with the switch and is for controlling the switch to be open or closed based on the starter being used to activate the cranking subsystem and at least one other criteria. The at least one other criteria is programmed into the controller.

According to the system and method disclosed herein, the present invention allows power to the cranking subsystem to be controlled based on a variety of factors. As a result, the cranking subsystem can be protected from over-cranking.

DETAILED DESCRIPTION OF THE INVENTION

Figure 1A:
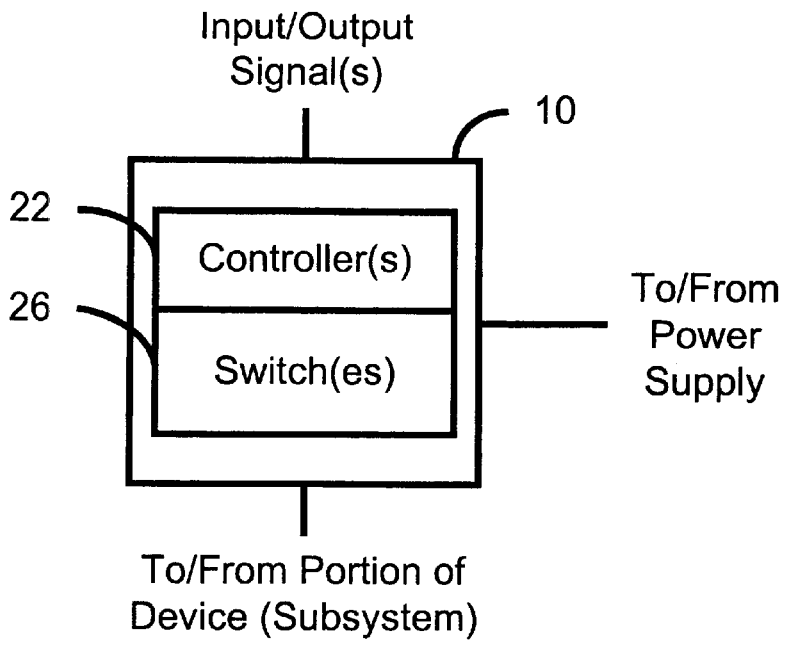
FIG. 1A is a high-level block diagram of one embodiment of an intelligent power management system in accordance with the present invention.

The present invention relates to an improvement in power management technology, particularly for DC electrical power sources which may have limited capacity. The following description is presented to enable one of ordinary skill in the art to make and use the invention and is provided in the context of a patent application and its requirements. Various modifications to the preferred embodiment will be readily apparent to those skilled in the art and the generic principles herein may be applied to other embodiments. Thus, the present invention is not intended to be limited to the embodiment shown, but is to be accorded the widest scope consistent with the principles and features described herein.

The present invention provides a method and system for controlling power to a cranking subsystem in a device having a power source. The cranking subsystem is coupled to an engine and a starter that allows a user to activate the cranking subsystem. The method and system include providing a switch and at least one controller. The switch is coupled between the power source and the cranking subsystem. The at least one controller is coupled with the switch and is for controlling the switch to be open or closed based on the starter being used to activate the cranking subsystem and at least one other criteria. The at least one other criteria is programmed into the controller.

The present invention will be described in terms of a particular configuration and particular devices. However, one of ordinary skill in the art will readily recognize that this method and system will operate effectively for other configurations, including other connections with power sources and power consumers. Furthermore, one of ordinary skill in the art will readily recognize that the present invention can be used in a variety of other devices, such as satellites, boats, or other devices.

To more particularly illustrate the method and system in accordance with the present invention, refer now to 1A, which depicts a high-level block diagram of one embodiment of an intelligent power management system, or power management module ("PMM") 10 in accordance with the present invention. The PMM 10 depicted is essentially an intelligent switch which can be considered to include at least a controller 22 and switches 26. The controller 22 and switches 26 are preferably integrated together in a single module. The switches 26 are preferably solid state devices such as MOSFET switches. The controller 22 is preferably a programmable microcomputer. Thus, the controller 22 may be individually tailored for functions desired by a user of the PMM 10. The controller 22 can receive input signals in order to aid in controlling the switches 26. For example, the controller 22 can receive signals from a device with which the PMM 10 is being used or from internal sensors which may be coupled to one or more of the switches 26. The switches 26 are coupled with a power supply and a portion of the device, such as a subsystem. Thus, depending upon whether a particular switch 26 is closed, power may be provided to a subsystem of the device. Using the intelligence in the controller 22 and the switches 26, the PMM 10 can control the switching of power to portions of the device in which the PMM 10 is used. Thus, the PMM 10 can act as an intelligent switch. As a result, power management in the device can be improved.

Figure 1B:
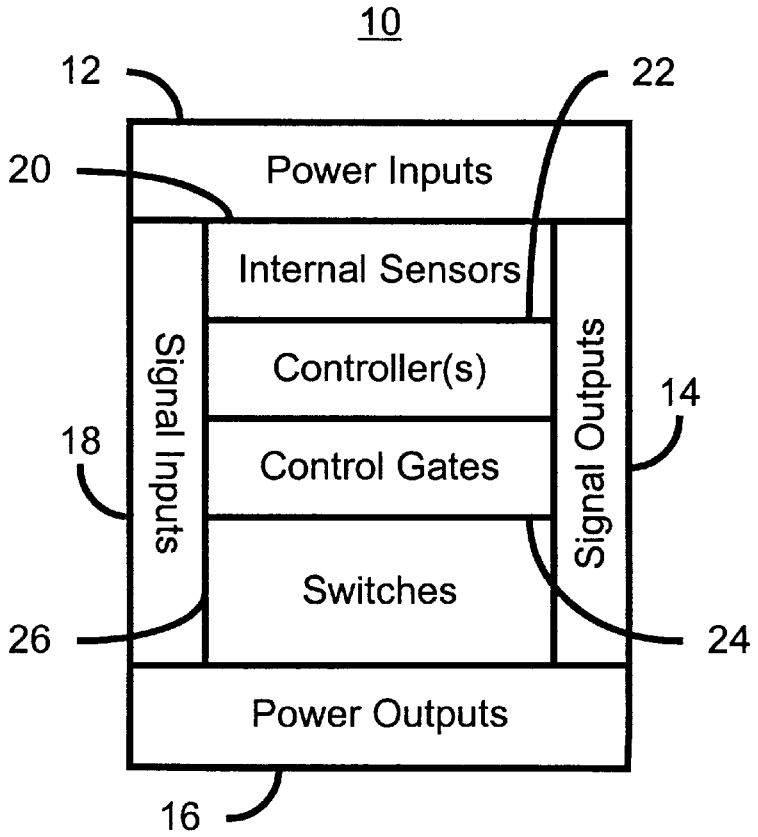
FIG. 1B is a block diagram of one embodiment of an intelligent power management system in accordance with the present invention.

FIG. 1B depicts a more detailed diagram of one embodiment of an intelligent power management system, or PMM 10, in accordance with the present invention. The PMM 10 includes power input 12, power output 16, signal inputs 18, signal outputs 14, internal sensors 20, a controller 22, switches 26 and, preferably, control gates 24 for the switches 26. The switches 26 are preferably devices such as MOSFET switches. The controller 22 is preferably a programmable microcomputer. Thus, the controller 22 may be individually tailored for functions desired by a user of the PMM 10. The controller 22 can communicate with portions of the device in which the PMM 10 is used via the signal input 18 and signal output 14. Thus, the controller can receive signals from a device with which the PMM 10 is being used through the signal input 18. Furthermore, the controller 22 can provide data and commands to the device through the signal output 14. The internal sensors 20 monitor the condition of the PMM 10. For example, the internal sensors 20 could include temperature sensors for various portions of the PMM 10, such as the switches 26, as well as current and voltage sensors for the switches 26. The internal sensors 20 may also include a timer, or clock, (not explicitly shown in FIG. 1B). In a preferred embodiment, the internal sensors 20 include temperature, voltage, and current sensors for each of the switches 26.

Figure 1C:
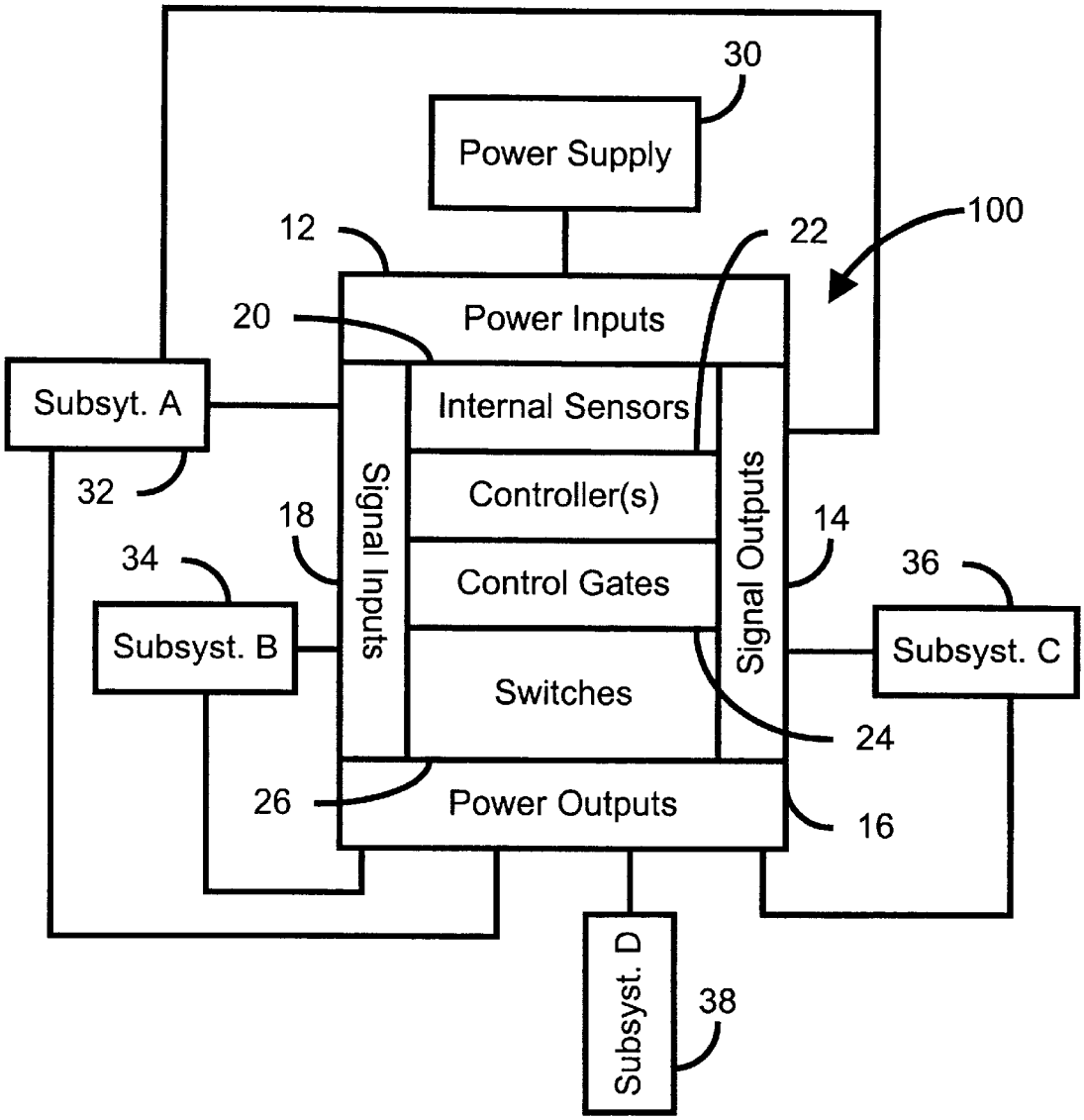
FIG. 1C is a block diagram of one embodiment of the intelligent power management system as coupled with a device.

FIG. 1C depicts an embodiment of the PMM 100 coupled with subsystems of a device. The PMM 100 is preferably the same as the PMM 10, though components are numbered differently. The PMM 100 still includes the signal input 18, the signal output 14, the power input 12, the power output 16, the internal sensors 20, the controller 22 and switches 26. Not depicted are the control gates 24 which may be provided. The PMM 100 is coupled to a power supply 30 through the power input 12. The power supply 30 includes at least one or more power storage devices (not explicitly shown), such as a battery, and may also include power generating devices (not explicitly shown), such as one or more alternators. In a preferred embodiment, the PMM 100 is separately coupled to the alternator and battery. The PMM 100 receives signals from subsystem A 32 and subsystem B 34 through the signal input 18. The PMM 100 provides signals to subsystem A 32 and a subsystem C 36 using the signal output 14. The PMM 100 is also coupled to subsystem A 32, subsystem B 34, subsystem C 36 and subsystem D 38. The PMM 100 is capable of a variety of functions, including but not limited to one or more of the following: managing the generation and storage of power, monitoring and controlling power consumption, cutting off power to one or more consumers based on a variety of programmable factors, providing step down power conversion of the power supplied by the power source 30, providing protection against spikes, providing protection against shorts, providing reverse polarity protection, providing a self learning capability, learning the signatures of one or more subsystems, diagnosing potential failures based on the signatures of one or more subsystems, protecting against potential failures based on the signatures of one or more subsystems, and protecting against drainage of the power source 30.

Figure 1D:
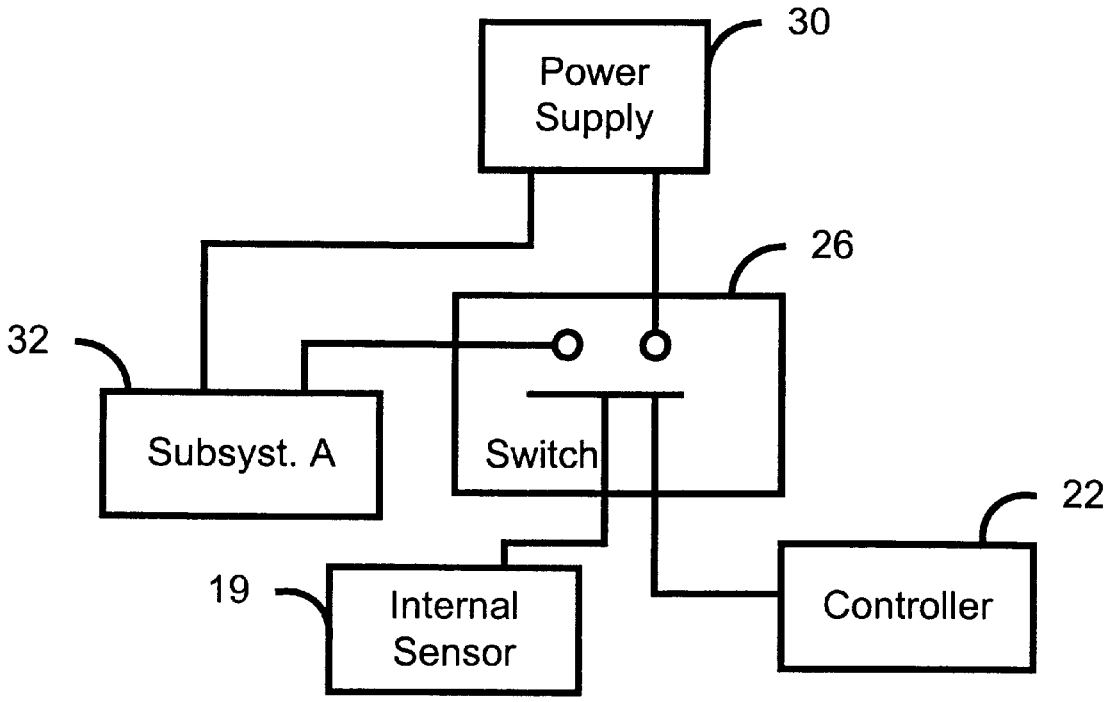
FIG. 1D is a block diagram of one embodiment of the intelligent power management system as coupled with a device.

FIG. 1D depicts one embodiment of a portion of the PMM 10 or 100 and the device to which the PMM 10 is coupled. The switch 26, which is one of the switches of the PMM 10, is connected between the power supply 30 of the device and the subsystem A 32 of the device. Consequently, when the switch 26 is open, as depicted in FIG. 1D, no power is provided to the subsystem A 32. However, when the switch 26 is closed, power is provided to the subsystem A 32. Also depicted are the controller 22 and internal sensor 19 coupled with the switch 26. Other or different components internal to the PMM 10 or 100 can be coupled with the switch 26. For example, in a preferred embodiment, current, voltage and temperature through the switch 26 are also monitored. The internal sensor 19 provides to the controller 22 an electrical signal indicating a property of one or more of the switches 26. Using the signal from the internal sensor 19 and/or other signals input to the controller 22 and based on the instructions provided to the controller 22, the controller 22 can control the switch to be open or closed.

Figure 1E:
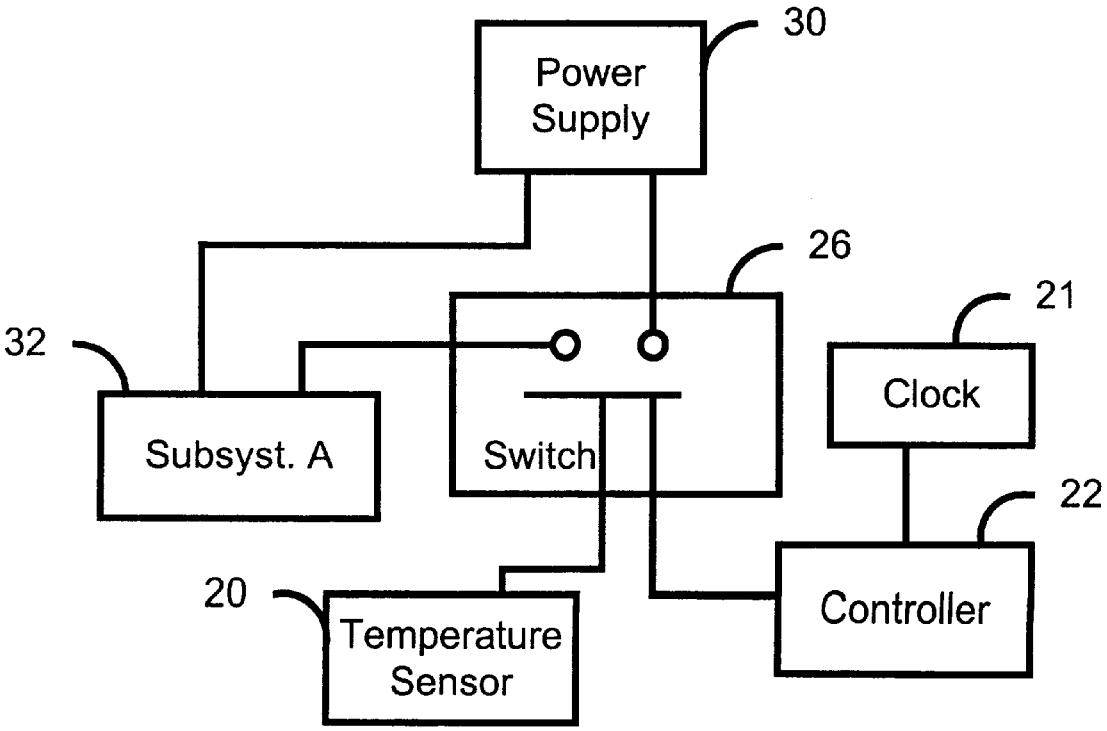
FIG. 1E is a block diagram of one embodiment of how a switch of the intelligent power management system is coupled with a portion of a device.

FIG. 1E depicts one embodiment of a portion of the PMM 10 or 100 and the device to which the PMM 10 or 100 is coupled. The switch 26, which is one of the switches of the PMM 10, is connected between the power supply 30 of the device and the subsystem A 32 of the device. Consequently, when the switch 26 is open, as depicted in FIG. 1E, no power is provided to the subsystem A 32. However, when the switch 26 is closed, power is provided to the subsystem A 32. Also depicted are the controller 22, temperature sensor 20 and clock 21 coupled with the switch 26. Other or different components internal to the PMM 10 or 100 can be coupled with the switch 26. For example, in a preferred embodiment, current and voltage through the switch 26 are also monitored. The temperature sensor 20 is thermally coupled with the switch 26 and coupled with the controller 22. Preferably, the temperature sensor 20 provides to the controller 22 an electrical signal indicating the temperature of the switch 26. The clock 21 is coupled to the controller 22 and can provide an indication of how long the switch 26 has been open or closed.

Figure 1F:
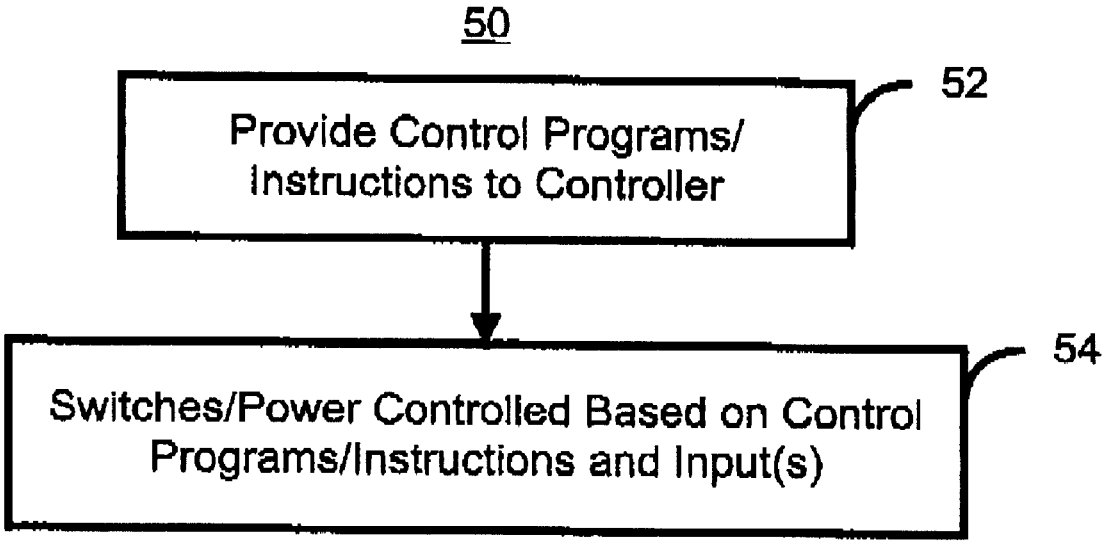
FIG. 1F is a high level flow chart of the functions of the power management module in accordance with the present invention.

FIG. 1F depicts a high-level flow chart of one embodiment of a method 50 for using the PMM 10 or 100 in accordance with the present invention. One or more control programs are provided to the controller 22, via step 52. The controller 22 then controls the power supplied to different power consumers based on the program and other inputs to the PMM 10 or 100, via step 54. Thus, the controller 22 opens or closes the switches 26 under certain conditions. The data provided by the internal sensors 20, an internal clock or information provided by the subsystems of the device that are connected to the signal input 18 inform the controller 22 as to the condition of the PMM 10 or 100 and the device to which the PMM 10 or 100 is connected. The PMM 10 or 100 can use this data with the instructions provided in the controller in order to determine when to open or close the switches 26. For example, the PMM 10 or 100 can determine whether the data meet certain criteria and operate the switches 26 accordingly.

To further illustrate the structure, functions, and capabilities of the present invention, reference will be made to the use of a PMM in the context of a particular device, a truck tractor. However, one of ordinary skill in the art will readily realize that analogous or functions may be provided by a PMM in other devices.

Figure 2A:
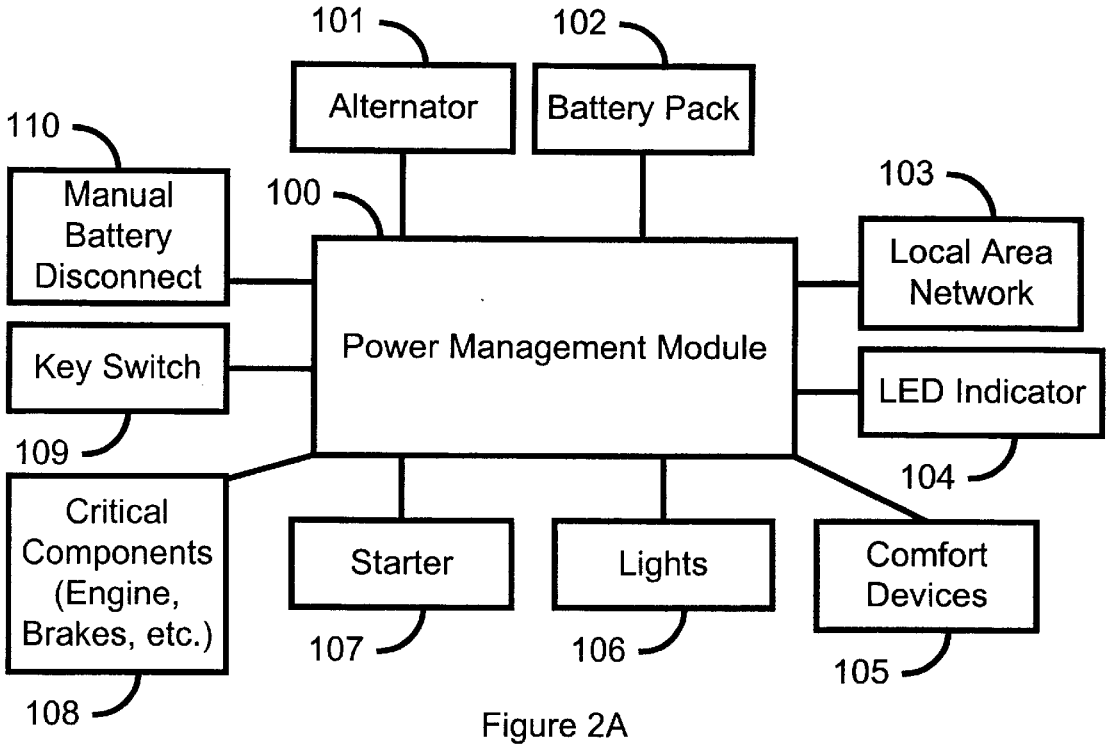
FIG. 2A is a high-level block diagram of one embodiment of a power management module in accordance with the present invention is used in a truck tractor.

FIG. 2A depicts a PMM 100 as it is coupled with subsystems in a truck tractor. Although numbered differently, components of the PMM 100 shown in FIG. 2A correspond to similarly named components in the PMM 10 shown in FIGS. 1A–E. Referring back to FIG. 2A, The truck tractor includes two power supplies, an alternator 101 which generates power and a battery pack 102 which stores power. The truck tractor also includes various subsystems such as a local area network 103, and LED indicator 104, comfort devices 105, lights 106, a starter 107, critical components 108, a start key switch 109 and a manual battery disconnect switch 110. The comfort devices 105 may include components such as a radio, refrigerator, or other devices. The critical components 108 include the engine, brakes, and other components.

Figure 2B:
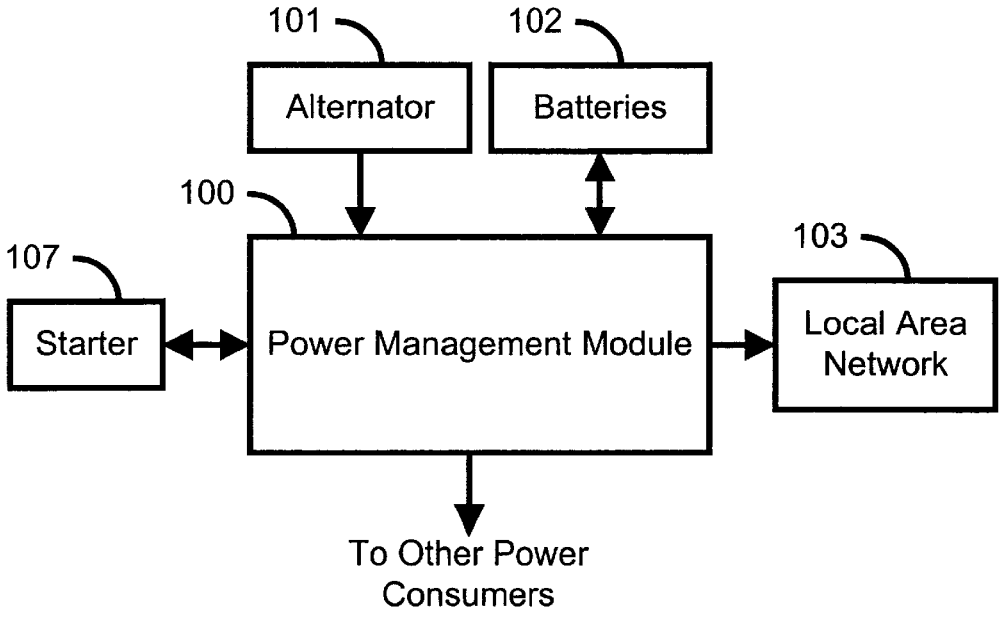
FIG. 2B is another high-level block diagram of one embodiment of a power management module in accordance with the present invention is used in a truck tractor.

FIG. 2B is another high-level diagram of the PMM 100 as coupled with certain subsystems in a device such as a truck tractor. The PMM 100 is depicted as being coupled to the batteries 102 and the alternator 101, the starter 107, other power consumers, and the LAN 103. Based on communication with the batteries 102, alternator 101, and various subsystems of the truck tractor, the PMM 100 can control switches (not explicitly shown in FIG. 2B) within the PMM 100 and can communicate with portions of the truck tractor so that a variety of functions are performed. These functions include but are not limited to those disclosed in the present application. As depicted in FIG. 2B, the PMM 100 may recognize differing power requirements for the batteries 102 under different conditions and determine the power drawn by the subsystems of the truck tractor. For example, the PMM 100 may recognize the ideal charge for the batteries 102 over a range of battery temperatures, battery capacity, and various requirements of the starter, such as voltage and current. The PMM 100 may also communicate with the batteries 102 to determine the remaining life in the batteries 102. Consequently, the PMM 100 may control other portions of the truck tractor and the power provided to the batteries 102 to meet the requirements of the batteries 102. Thus, the PMM 100 may ensure that the batteries 102 are charged close to the ideal level and may regulate power to power consumers to extend the life of the batteries 102 or ensure that the batteries 102 have sufficient power for critical applications. Consequently, the PMM 100 may identify and prevent potential failure of the batteries 102. The PMM 100 also receives signals from and provides signals to the alternator 101. Thus, potential failures of the alternator 101 or harm due to problems within the alternator 101 or other portions of the truck tractor may be prevented. The output of the alternator 101 may also be controlled based on signals provided from the PMM 100, for example to optimize battery power. In addition, switches between the alternator 101 and other portions of the truck tractor, including the batteries 102, may be provided. The PMM 100 may control these switches to provide the desired power to other portions of the truck tractor. Furthermore, the PMM 100 communicates with the starter (cranking) subsystem 107, identifying impending failure and preventing harm to the starter 107 due to system failure or user abuse. The power to the starter 107. may also be controlled based on other factors, such as the power remaining in the batteries 102 or the temperature of switches in the PMM 100. The PMM 100 also communicates with the LAN 103 for the truck tractor and other power consumes. Information relating to the status of the truck tractor may be communicated between the LAN 103 and the PMM 100. In addition to communicating with various other subsystems, the PMM 100 may control each subsystem's power consumption. For example, the PMM 100 may cut off power to the subsystems or reduce power to the subsystem. The PMM 100 may also control power to the subsystems to ensure that power in the batteries 102 or alternator 101 exists for critical needs and to ensure that the subsystems receive the appropriate amount of power. The PMM 100 may also monitor the subsystems to prevent harm from short circuits, spikes, or failures. The PMM 100 can also control and regulate power output to power sensitive devices, such as light bulbs.

Figure 3:
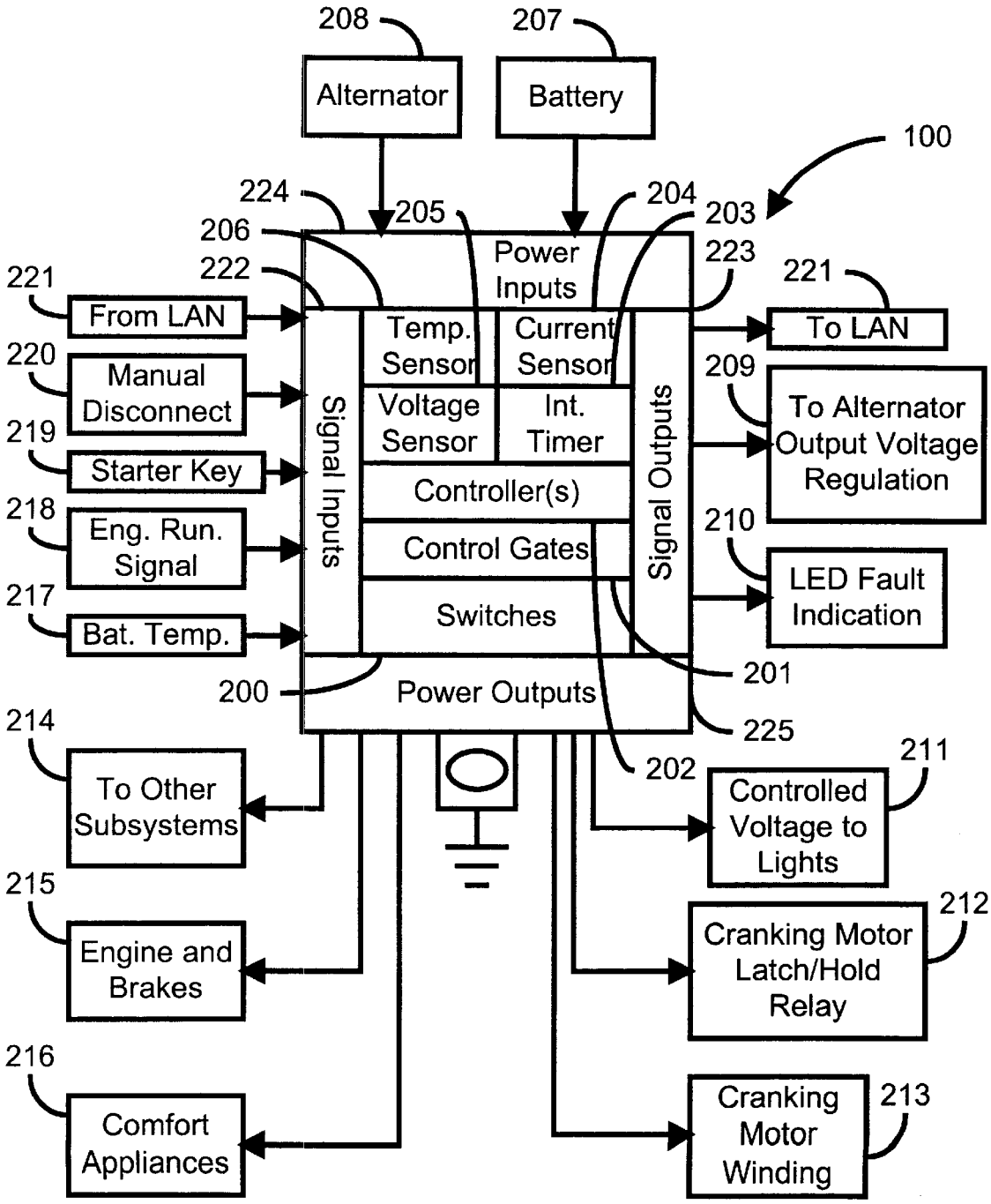
FIG. 3 is a more detailed block diagram of one embodiment of a power management module in accordance with the present invention is used in a truck tractor.

FIG. 3 more particularly illustrates the connections between the PMM 100 and subsystems of the truck tractor. Although numbered differently, components of the PMM 100 shown in FIG. 3 correspond to similarly named components in the PMM 100 shown in FIG. 2A. Referring back to FIG. 3, the PMM 100 includes signal inputs 222, signal outputs 223, power inputs 224 and power outputs 225. The PMM 100 also includes MOSFET switches 200, control gates 201 and a controller 202. The control gates 201 control the switches 200. The controller 202 controls the control gates 201 and, therefore, controls the switches 200. The controller 202 is preferably a programmable microcomputer. The PMM 100 also includes an internal timer 203, current sensors 204, voltage sensors 205 and temperature sensors 206. The current sensors 204, voltage sensor 205, and temperature sensors 206 monitor the current through, voltage across and temperature of, respectively, the switches 200. Preferably each of the switches 200 includes a current sensor 204, a voltage sensor 205, and a temperature sensor 206. In addition, the PMM 100 includes components for monitoring various portions of the truck tractor. For example, the PMM 100 may monitor the voltage across and current through certain power consumers and may monitor the charge level, rate of charge and rate of discharge of the battery 207.

The PMM 100 is coupled to two power supplies, battery 207 and the alternator 208. The PMM 100 receives signals from a local area network (LAN) line 221, a manual disconnect line 220, a starter key line 219, an engine running signal line 218, and a battery temperature sensor line 217 provided from a LAN (not shown), a manual disconnect switch (not shown), a starter key (not shown), an sensor indicating whether the engine is running (not shown) and a battery temperature sensor (not shown), respectively. The PMM 100 provides signals to a LAN, the alternator 208, and an LED via a communication to LAN line 221, a input to alternator output voltage regulation line 209, and an LED fault indication line 210. Consequently, the PMM 100 can receive data from, provide data to, and provide commands to different subsystems of the truck tractor. For example, the manual disconnect line 220 indicates whether the battery 207 and alternator 208 should be cut off by the PMM 100. The starter key line 219 indicates whether a user has turned a starter key to start up the engine of the truck tractor. The engine running signal line 218 indicates to the PMM 100 whether the engine is already running, allowing the PMM 100 to prevent power from flowing to the cranking subsystem when the engine is already on. The PMM 100 can monitor the temperature of the battery via line 217, and can monitor the voltage across the battery 207, for example to control charging of the battery 207. Furthermore, the PMM 100 can control output of the alternator 208 through the input to alternator output voltage regulation line 209. The PMM 100 can also indicate to the user if a fault has occurred via LED fault indication line 210. The temperature sensors 206 provide an indication of the temperature of the switches 200. This allows the controller to open one or more of the switches when their temperature is too high.

A typical alternator, such as the alternator 208, is three-phase alternating current generator. The rectifier circuit (not shown) in the alternator 208 converts alternating current (AC) to direct current (DC). Important components in the rectifier are diodes. When a diode or other component fails in one phase of the alternator 208, the alternator 208 will generate only two-thirds of the power. This will put significant stress on the two working phases of the alternator 208. This leads to quick and progressive failure of all phases of the alternator 208. Currently, conventional devices in the market place cannot detect the loss of a phase and prevent the rapid and eminent failure of the other phases. The PMM 100 can detect the loss of a phase through alternator signature recognition. In response, the PMM 100 can reduce the demand on the alternator 208. This will give time to fix the alternator at the next scheduled maintenance rather failing unexpectedly on a high way where the maintenance and downtime costs are excessive.

The alternator 208 has both stator and rotor windings. Any one of these windings can develop electrical short or open condition. When shorted or open condition develops, the alternator 208 will generate reduced electrical power. This will put significant stress on windings that are normal. Progressive failure of other components rapidly follows. Currently no conventional devices detect a short or open condition to prevent the failure of other components. The PMM 100 can detect the loss of a phase through alternator signature recognition, and reduces the demand on alternator 208. This will give time to fix the alternator 208 at the next scheduled maintenance rather failing unexpectedly, resulting in excessive maintenance and downtime costs.

Furthermore the PMM can detect and account for the failure of the belt and pulley system driving the alternator. When the belt or pulley slips, the alternator cannot generate power that it is designed to generate. The slip condition heats up the belt, pulley, alternator bearings and other portions of the truck tractor. The PMM 100 can detect the existence of these conditions, using communication with the truck tractor and monitoring the difference between the behavior of the alternator and its signature. PMM can then take appropriate action, for example by providing an alarm to the user.

The PMM 100 can also monitor the power consumers and supplies. Thus, the PMM 100 is coupled with several subsystems that act as power consumers. For example, the PMM 100 is coupled with the lights, a cranking motor latch/hold coil, a cranking motor winding, other devices in the truck tractor, the engine and brakes, and comfort appliances via the lights line 211, a cranking motor latch/hold coil line 212, a cranking motor winding line 213, other devices in the truck tractor line 214, engine and brakes line 215, and comfort appliances line 216. Thus, in the embodiment shown in FIG. 3, the PMM 100 is coupled to the cranking subsystem through two lines 212 and 213. Using the lines 211, 212, 213, 214, 215, and 216, the PMM 100 can monitor and control power to various subsystems of the truck tractor, such as the lights, components of the cranking subsystem, the engine and brakes, comfort appliances, and other subsystems. For example, the PMM 100 can provide pulse width modulation (PWM) to control the magnitude of the power supplied to a particular subsystem. Thus, the voltage applied to the lights, the engine, and the brakes can be decreased as desired to extend the life of or better control components. The PMM 100 can also monitor and regulate the demand on the alternator, preferably by using PWM. For example, when the engine is started when the whether is cold, the battery charge is low and the power use is high, the electrical system will try to draw as much current as possible from the alternator 208 instantaneously. This condition puts high stress on and reduces the life of the alternator 208. The PMM 100 monitors and regulates the demand on the alternator 208 such that the stress on alternator is moderated and maintained at an optimum level. This is accomplished through PWM of alternator output.

The PMM 100 is also capable of keeping track of these information for various components such as starter (cranking subsystem), battery 207, alternator 208, light bulbs and others subsystems. Knowing the cycles and severity of operation is the accurate way of knowing the actual usage of these components. By knowing this, most optimum maintenance schedule can be used. This will avoid servicing or changing components before its time. This will also help to avoid not serving or changing components when it is time.

Figure 4:
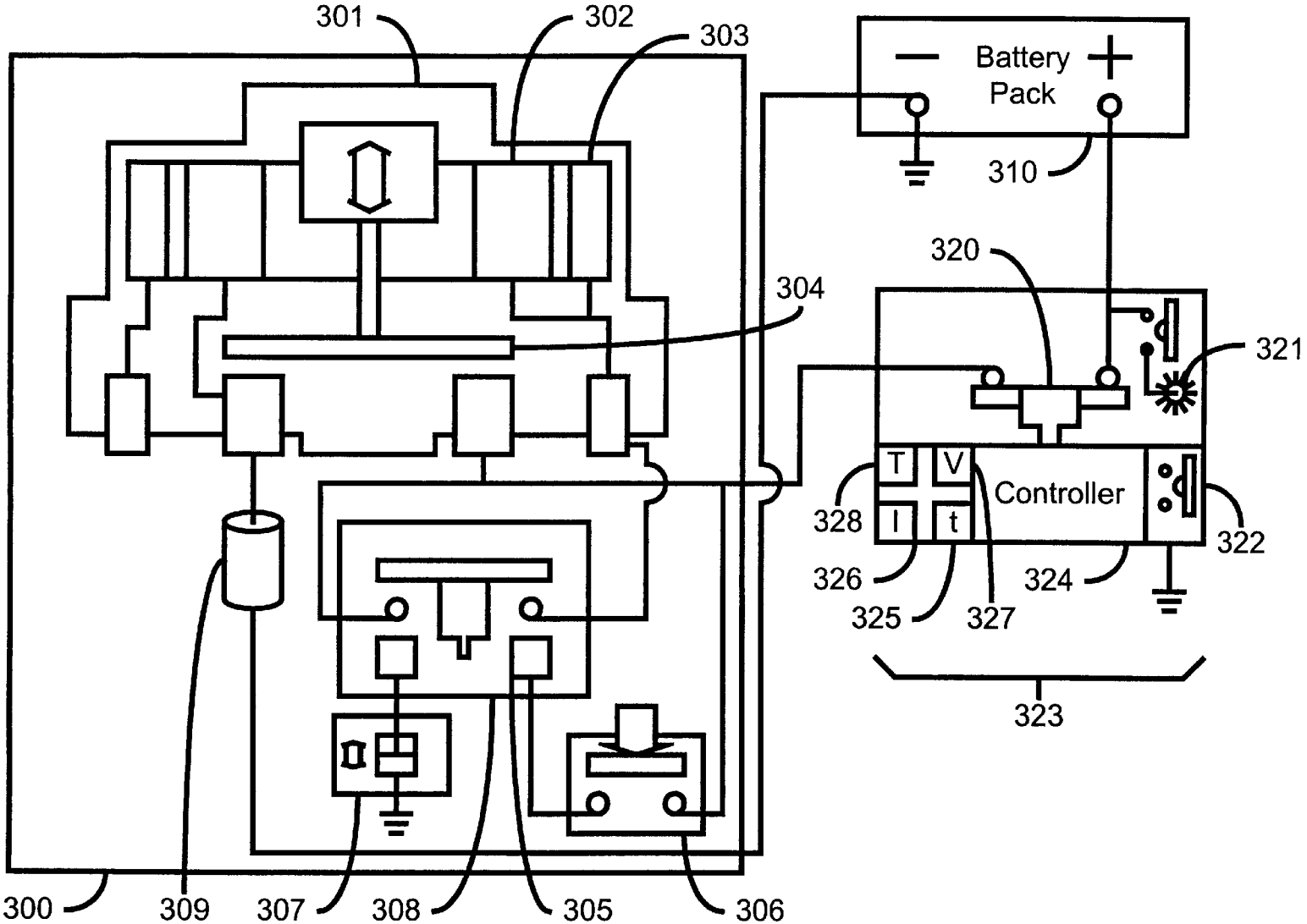
FIG. 4 is a diagram of one embodiment of how the power management module in accordance with the present invention can be used for auto-disconnect to protect against overcranking.

FIG. 4 depicts one embodiment of a system for controlling overcranking using the PMM 100. For clarity, only a portion of the PMM 100 is depicted in FIG. 4. Overcranking protection is desirable for a variety of reasons. Shorting of the main contacts 304 of the cranking subsystem 300 could cause a fire. Similarly, continued overcranking by a user could drain the battery pack 310 and cause damage to the truck tractor. Thus, a portion of the PMM 100 is shown in conjunction with a battery pack 310 and a portion of the cranking subsystem 300. The portion of the PMM 100 is indicated as the INTRA smart switch 323. Although numbered differently, components of the smart switch 323 correspond to similarly named components in the PMM 100. The smart switch 323 includes the controller 324, the switch 320, timer 325, current sensor 326, voltage sensor 327, temperature sensor 328, and an LED 321 to indicate whether the switch 320 is open. The switch 320 is coupled to the positive terminal of the battery pack 310, while the negative terminal of the battery pack 310 is connected to the cranking subsystem 300. Note that the switch 323 could be coupled between the negative terminal of the battery pack 310 and the cranking subsystem 300, rather than between the positive terminal and the cranking subsystem 300. The cranking subsystem 300 includes the starter solenoid 301, the pull-in winding 302, the hold-in winding 303, main contacts 304, a starter magnetic switch coil 305, the a start switch 306, a thermal switch 307, a magnetic switch 308, and motor windings 309. The pull-in windings 302 and hold-in windings 303 control the pulling and holding in of the starter motor gear (not shown) with the gears of the engine. The start switch 306, which is normally open, is closed only when a user attempts to start the truck tractor.

When the start switch 306 is closed, the controller 324 may close the switch 320. The controller 324 may impose conditions other than the start switch 306 being closed for the switch 320 to close. For example, the controller may only close the switch if there is a minimum voltage level of the battery 310 or a particular temperature of the switch 320 that is less than a particular level. Thus, the controller 324 uses instructions provided, as described in FIGS. 1F and 6A–C, to determine whether certain conditions are met and control the switch accordingly. When the switch 320 is closed, the positive terminal of the battery 310 is connected to the magnetic switch 308 which controls power to the main contacts 304, the pull-in winding 302 and the hold-in winding 303. Closing of the switch 320 also allows power to be provided to the main contacts 304. The magnetic switch 308 closes, allowing power to flow to the pull-in winding 302 and the hold-in winding 303. The pull-in winding 302 then pulls the front gear of the starter motor (not shown) to the engine's front gear (not shown). The hold-in winding 303 then holds the starter motor front gear in position. The main contacts 304 close when the starter motor's front gear is engaged with the engine's front gear. Power to the pull-in windings 302 is then cut, while power is applied to the hold-in windings 303 and the motor windings 309.

Based on certain criteria, the controller 324 may not close the switch 320. Thus, no power will be provided to the cranking subsystem 300 and cranking will be prevented. Furthermore, based on some criteria, the controller 324 may open the switch 320, automatically disconnecting power to the cranking subsystem 300. As a result, cranking will be stopped. The criteria used for refusing to close the switch and the criteria used for opening the switch may be programmed into the controller 324. In a preferred embodiment, the criteria include providing a particular current to the cranking subsystem 300 for more than a particular amount of time; the temperature, voltage or current through the switch 320 exceeding particular thresholds, and the battery pack 310 having a voltage that is below a particular level. Thus, if power through the main contacts 304 is larger than desired, for example because the main contacts 304 are becoming welded, the switch 320 can be opened. Also in a preferred embodiment, the PMM 100 will open the switch 320 when the behavior of the cranking subsystem 300 deviates from an expected behavior by a certain amount. Furthermore, the PMM 100 could control the switch 320 based on other criteria, such as signals input to the PMM 100 from the engine or other portion of the truck tractor.

Figure 5:
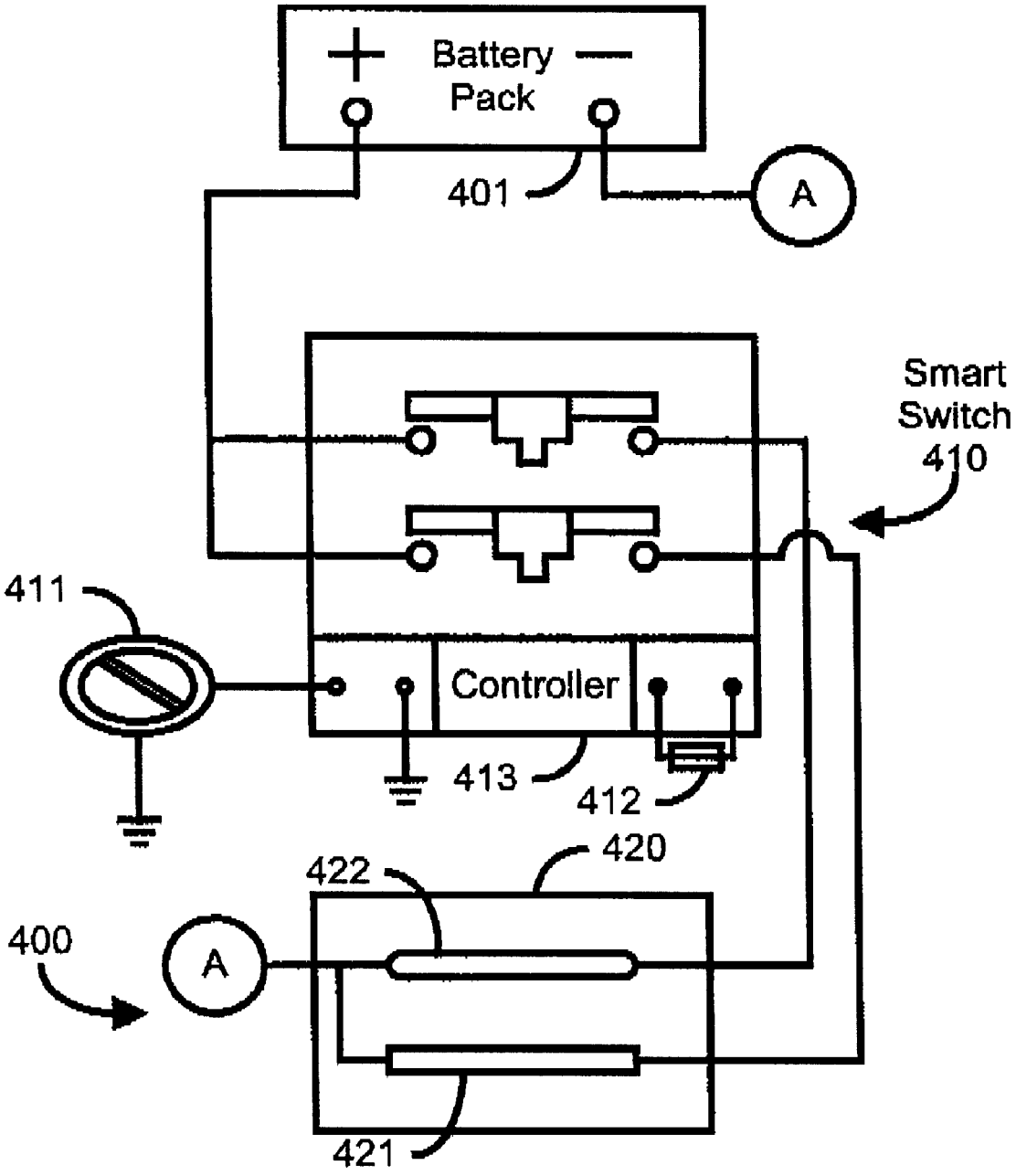
FIG. 5 is a diagram of another embodiment of how the power management module in accordance with the present invention can be used for auto-disconnect to protect against overcranking.

FIG. 5 depicts another embodiment of a system for controlling overcranking using the PMM 100. Thus, a portion of the PMM 100 is sown in conjunction with a battery pack 401 and a portion of the cranking subsystem 400. The portion of the PMM 100 is indicated as the INTRA smart switch 410. Although numbered differently, components of the smart switch 410 correspond to similarly named components in the PMM 100. The smart switch 410 includes the controller 413, the motor coil power switch 415 and a relay latch and hold coil switch 414 (collectively referred to as switches 416) and receives inputs indicating whether the engine is running and whether the start switch has been turned via lines 412 and 411, respectively. The switches 416 are coupled to the positive terminal of the battery pack 401, while the negative terminal, or ground, of the battery back 401 can be viewed as being connected to the cranking subsystem 400. Note, however, that the switches 416 could be coupled between the negative terminal of the battery pack 401 and the cranking subsystem 400, rather than between the positive terminal and the cranking subsystem 400. The portion of the cranking subsystem 400 shown is a single latch (pull-in) and hold coil winding 422 and a motor coil winding 421. Other components of the cranking subsystem 400 are not depicted for clarity.

The embodiment shown in FIG. 5 allows the single latch and hold coil winding 422 to replace the hold-in winding 303 of the cranking subsystem 300 depicted in FIG. 4. Referring back to FIG. 5, when the start switch is closed, the controller 413 may close the switches 416. The controller 413 may impose conditions other than the start switch being closed for the switches 416 to close. For example, the controller may only close the switch if there is a minimum voltage level of the battery 401 or particular temperatures of the switches 316 that are less than particular levels. The criteria used in controlling the switches are preferably programmed at or around the time the instructions are provided to the controller. Preferably, the relay latch and hold coil switch 414 is closed first. When the relay latch and hold coil switch 414 is closed, the positive terminal of the battery 401 is connected to the single latch and hold coil winding 422. The single latch and hold coil winding 422 then pulls the front gear of the starter motor (not shown) to the engine's front gear (not shown) and holds the starter motor front gear in position. In a preferred embodiment, the power to the single latch and hold coil winding 422 is reduced when the starter motor's front gear is engaged with the engine's front gear. This is because it takes less power to hold the starter motor's front gear in place than to pull the front gear into place. This reduction in power can be accomplished using pulse width modulation, or opening and closing the switch 414 at a rate which results in reduced power of the desired magnitude being provided to the single latch and hold coil winding 422. The motor coil power switch 415 is also closed, allowing current to flow to the motor coil winding 421 and the cranking subsystem 400 to crank the engine.

Based on certain criteria, the controller 413 may not close one or more of the switches 416. Thus, no power will be provided to the cranking subsystem 400 and cranking will be prevented. Furthermore, based on some criteria, the controller 413 may open the one or more of the switches 416, automatically disconnecting power to the cranking subsystem 400. As a result, cranking will be stopped. The criteria used for refusing to close the switches 416 and the criteria used for opening the switches 416 may be programmed into the controller 413. In a preferred embodiment, the criteria include providing a particular current to the cranking subsystem 400 for more than a particular amount of time; the temperature, voltage or current through one or more of the switches 416 exceeding particular thresholds, and the battery pack 401 having a voltage that is below a particular level. Also in a preferred embodiment, the PMM 100 will open the switches 416 when the behavior of the cranking subsystem 400 deviates from an expected behavior by a certain amount. Furthermore, the PMM 100 could control one or more of the switches 416 based on other criteria, such as signals input to the PMM 100 from the engine or other portion of the truck tractor.

Because the switches 416 control current to the motor coil winding 421 and the single latch and hold coil windings 422, the main contacts 304, the hold-in winding 303, the magnetic switch 308 and the thermostat 307 shown in FIG. 4 may be eliminated. The main contacts 304 can be eliminated because the motor coil power switch 415 is used to control current to the motor coil winding 421. The hold-in windings 303 can be eliminated because the controller 413 controls the relay latch and hold coil switch 414 to provide PWM. In other words, the controller 413 controls the relay latch and hold coil switch 414 to open and close at a desired rate, which results in PWM. PWM steps down the power provided to the single latch and hold coil windings 422. Thus, the single latch and hold coil winding 422 can be used to engage the starter motor's front gear, which requires a certain amount of power, and to hold the starter motor's front gear in place, which requires less power, without overheating.

Figure 6A:
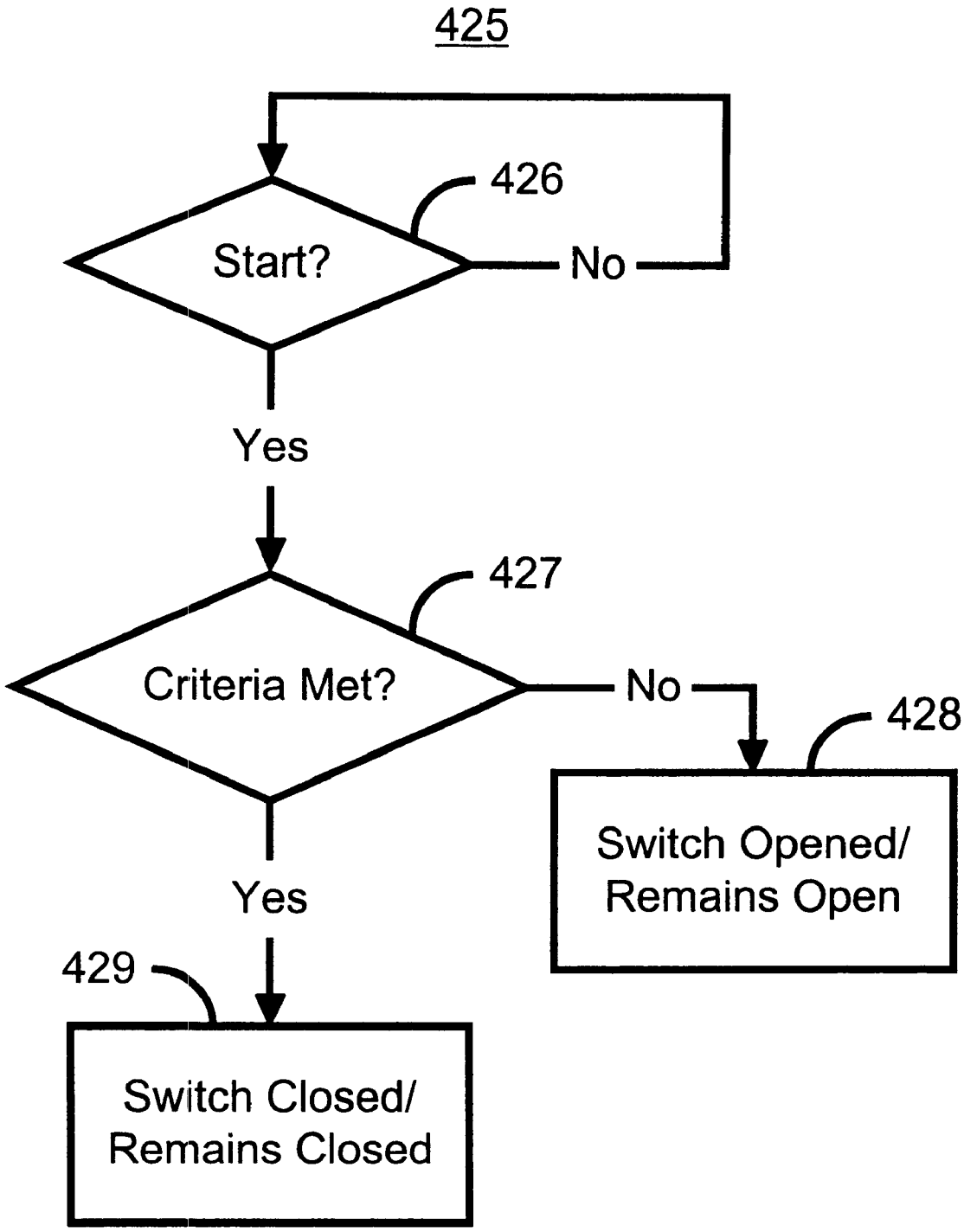
FIG. 6A is a high-level flow chart depicting one embodiment of a method for providing protection against overcranking using the power management module in accordance with the present invention.

FIG. 6A depicts a high-level flow chart of one embodiment of a method 425 in accordance with the present invention for controlling power to the cranking subsystem. It is determined whether the truck tractor is to be started, via step 426. In one embodiment, step 426 includes determining whether the start switch 306 has been closed, indicating that power is desired to be supplied to the cranking subsystem 300. If the truck tractor is not to be started, then nothing happens. Thus, step 426 may be repeated. If, however, the truck tractor is to be started, then it is determined whether the desired criteria have been met, via step 427. Step 426 is preferably performed by the controller 324 and may utilize information provided to the controller from the PMM 100 itself or from portions of the truck tractor. For example, the criteria in step 427 could include one or more of the following: whether the temperature of the switch in the PMM 100 is less than a particular temperature; determining whether the voltage and or current through the switch or the cranking subsystem meet or exceed certain values, whether the engine is already running or other criteria such as those discussed with respect to FIGS. 6B–C, below. The criteria are preferably programmed into the controller before or when the PMM is placed in the truck tractor. Referring back to FIG. 6A, if it is determined that the criteria are not met, then the switch is opened or allowed to remain open, via step 428. Thus, power is cut off from or not allowed to flow to the cranking subsystem. If, however, the criteria are met, then the switch is closed or allowed to remain closed, via step 429. Thus, power is provided to or allowed to continue to flow through the cranking subsystem.

Figure 6B:
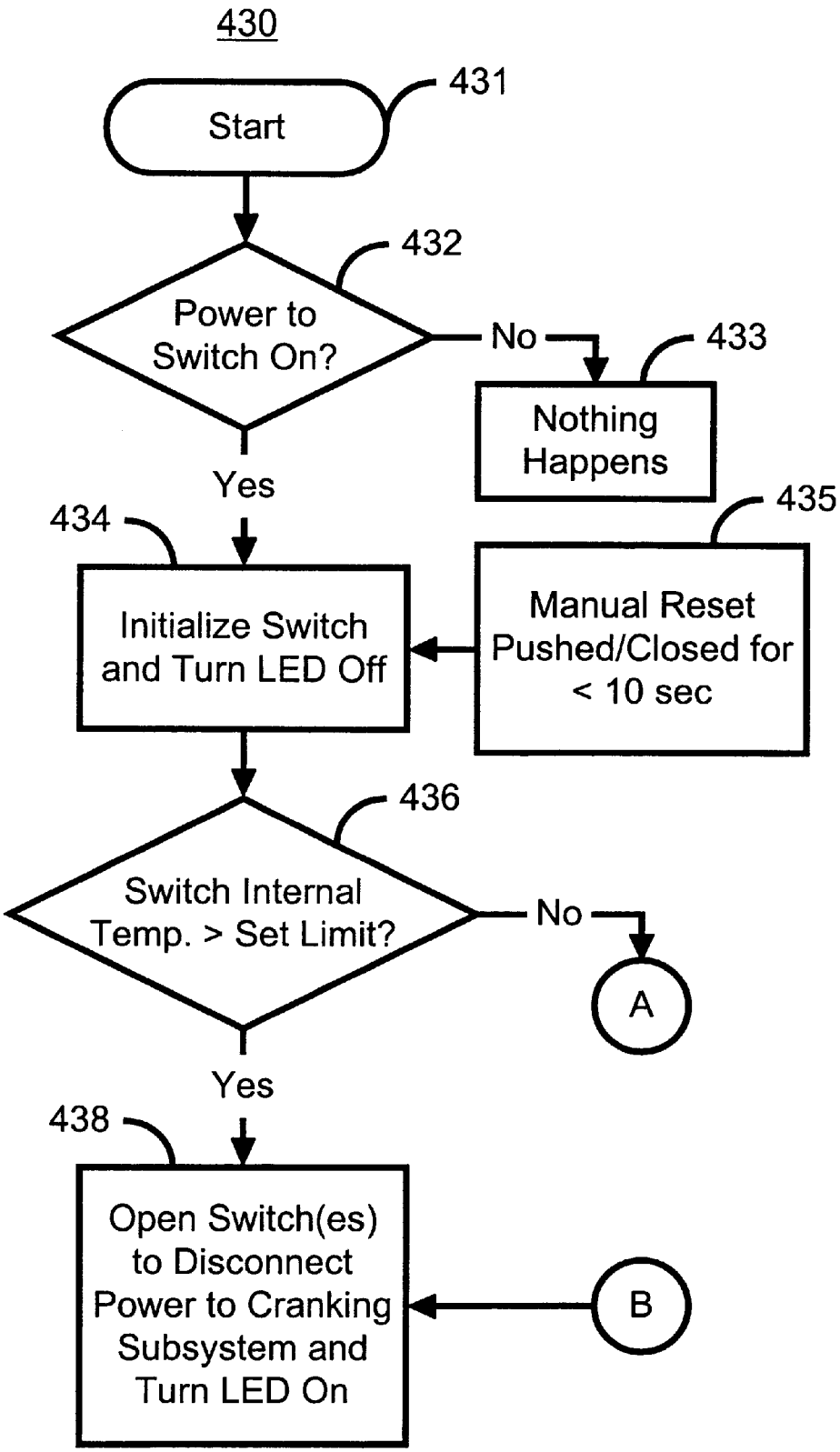
FIGS. 6B–C are a flow chart depicting one embodiment of a method for providing protection against overcranking using the power management module in accordance with the present invention.
Figure 6C:
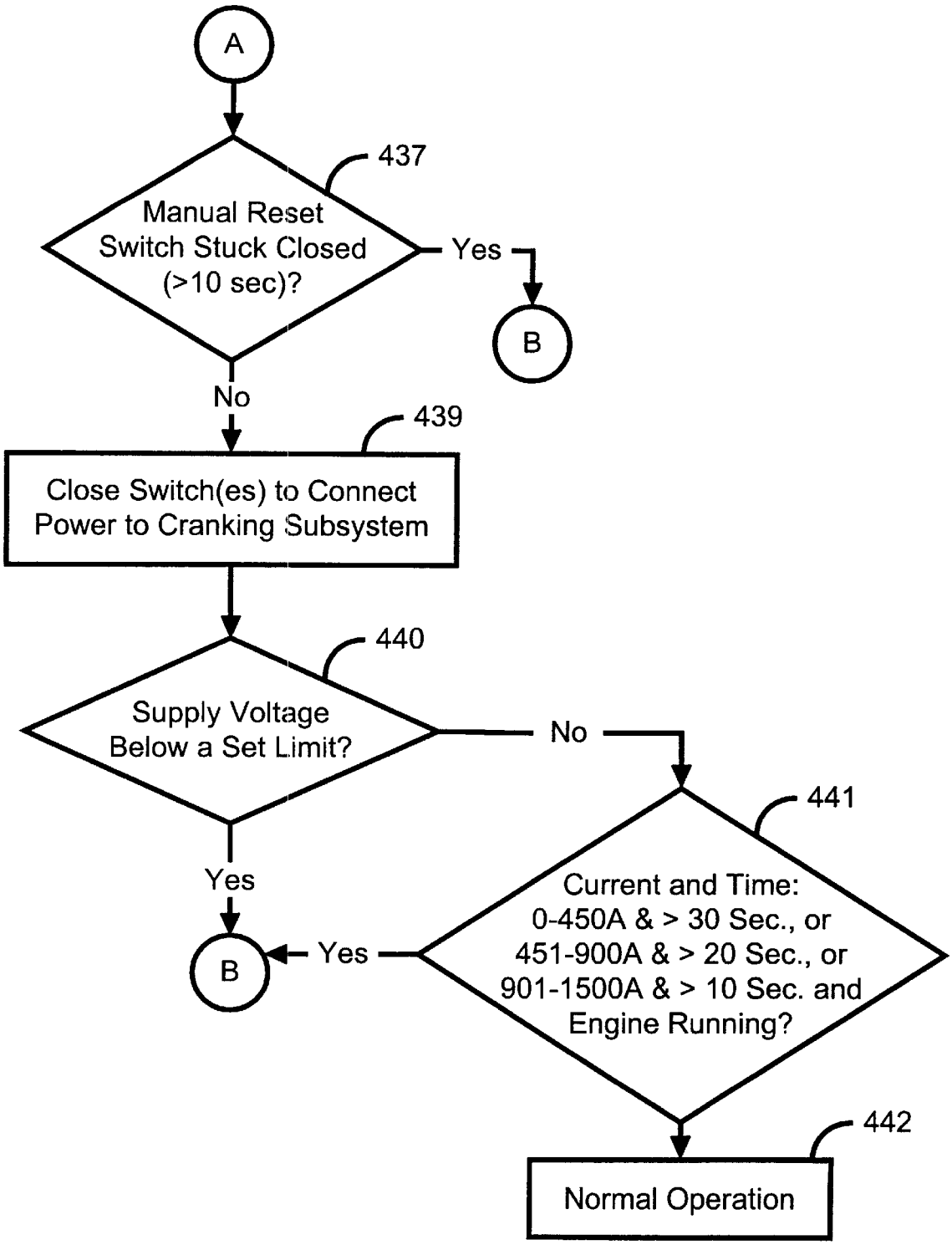

FIGS. 6B–C depict a more detailed flow chart of one embodiment of a method 430 for controlling overcranking in accordance with the present invention. The method 430 is preferably used by the PMM 100 when connected as depicted in FIG. 4. However, the method 430 can be adapted for use in another system, such as the systems shown in FIG. 5 and FIG. 7. Referring FIGS. 6B–C and 4, the method starts at 431. It is determined whether there is power to the switch, or the PMM 100, via step 432. If the PMM 100 does not have power, the switches within the PMM 100 cannot be closed. Consequently, nothing happens, via step 433. Thus, step 432 may be returned to. If it is determined that there is power to the PMM 100, in step 432, then the PMM 100, or the appropriate switches in the PMM 100, are initialized and the LED indicating that the PMM 100 is not functional is shut off, via step 434. Step 434 is also performed if the manual reset switch (shown in FIG. 4 as the local manual reset switch 322) is pushed closed for less than a particular time, preferably ten seconds, in step 435. Once the PMM 100 is initialized, it is determined if the internal switch temperature for one or more switches is above a particular limit, via step 436. For example, step 436 may use the temperature sensor 328 to determine whether the temperature of the switch 320 is above the particular limit. The particular limit for a switch may depend upon the physical construction of the switch. If the temperatures of the switch or switches are above the limit, then the switch(es) remain open or are opened, depending on the current states of the switch(es), via step 438. If the internal switch temperatures for the switch(es) are below the particular limit, then it may be determined if the manual reset has been closed for greater than a particular time, preferably ten seconds, via step 437. Thus, step 437 may determine whether the manual reset switch is stuck closed. If so, then step 438 is performed. Otherwise, the switch(es) are closed, via step 439. Thus, power is provided to the appropriate portion(s) of the cranking subsystem. It is determined whether the voltage of the power supply, such as the battery pack 310, is below a particular point, via step 440. If so, then step 438 is performed. If the voltage is above the particular point, then step 441 is performed. Note that step 440 may be performed prior to step 439. If so, then step 439 is performed if the voltage of the power supply is above the particular point, while step 438 is performed if the voltage of the power supply is below a certain point. In such a case, step 441 would be performed after step 439. Step 441 determines whether the current through the switch(es) and time for which current has been flowing meet a certain relationship and whether the engine running input indicates that the engine is not on. Preferably, step 441 determines whether the currents and times are within the range for safe operation of the cranking system. The currents and times set in step 441 are sufficiently low to ensure that the switch(es) do not burn out. In the embodiment depicted in FIGS. 6B–C, the current and times which are set for the switch 321 are: between zero and four hundred fifty amps for greater than thirty seconds, between four hundred fifty-one and nine hundred amps for greater than twenty seconds, or between nine hundred and one and one thousand five hundred amps for greater than ten milliseconds. The currents and time selected could be different for other truck tractors or other applications. If the currents and times do not exhibit the selected relationships, then the switch(es) are opened in step 438. Steps in the method 430, such as steps 440 and 441 may be carried out continuously to ensure that no damage is done to the cranking subsystem 300 or to the PMM 100. Step 441 also checks to determine whether the engine is running. If the engine is running, then step 438 is performed to open the switches and stop power from flowing to the cranking subsystem. Other conditions can be added to step 441 or added as other steps to provide additional intelligence and features. Furthermore, determining whether the engine is running and determining whether other conditions are met could be performed at another point in the method 430 using a separate step. In such a case, the switch may merely remain open, preventing any power from flowing to the cranking subsystem.

Figure 7:
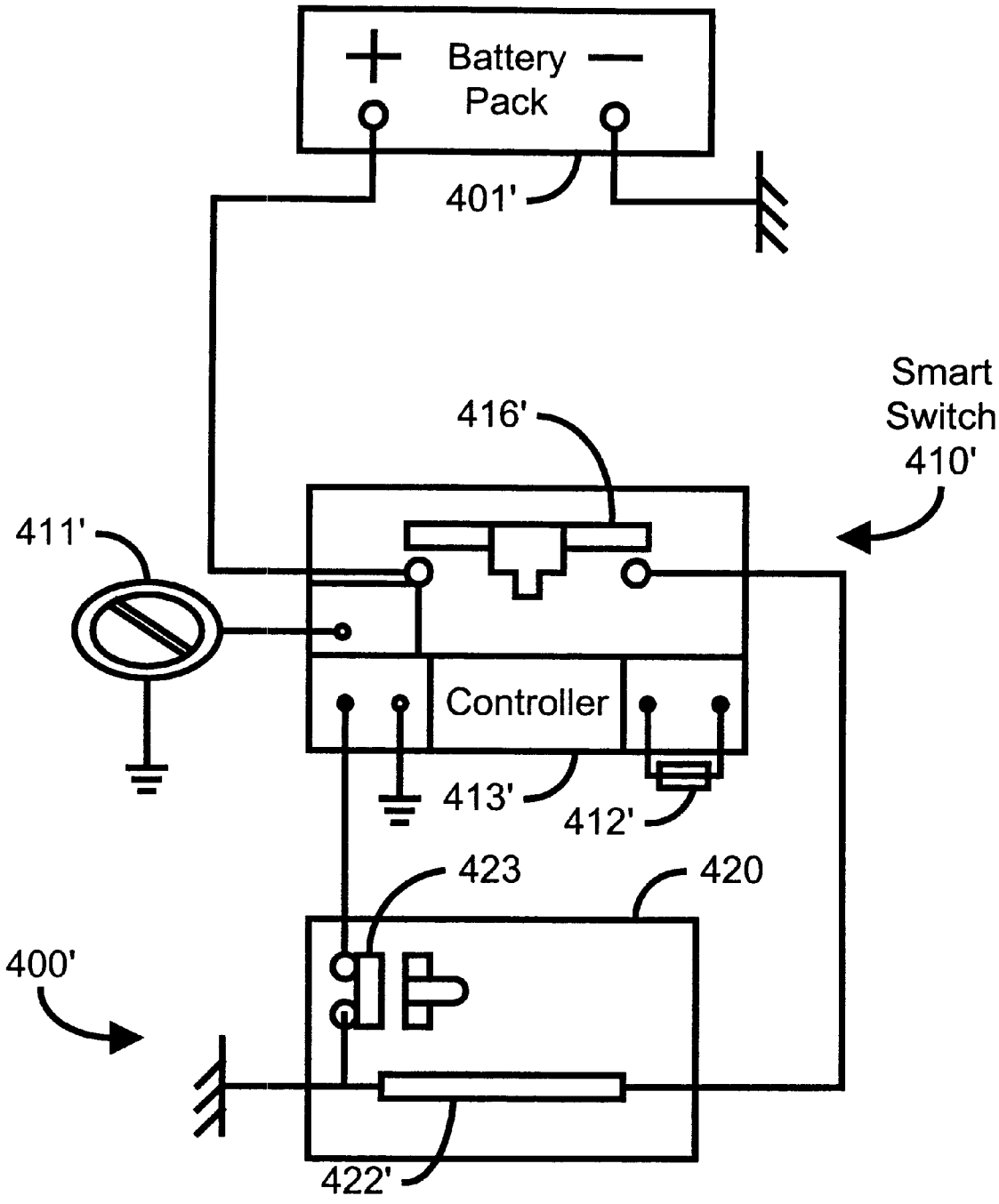
FIG. 7 is a diagram of a third embodiment of how the power management module in accordance with the present invention can be used for auto-disconnect to protect against overcranking.

FIG. 7 depicts another embodiment of a system for protecting against overcranking using the PMM 100. Thus, a portion of the PMM 100 is shown in conjunction with a battery pack 401' and a portion of the cranking subsystem 400'. The portion of the PMM 100 is indicated as the INTRA smart switch 410'. Although numbered differently, components of the smart switch 410' correspond to similarly named components in the PMM 100. The smart switch 410' includes the controller 413', switch 416' and receives inputs indicating whether the engine is running and whether the start switch has been turned via lines 412' and 411', respectively. The switch 416' is coupled to the positive terminal of the battery pack 401', while the negative terminal, or ground, of the battery back 401 ' can be viewed as being connected to the cranking subsystem 400'. The portion of the cranking subsystem 400' shown is a single latch (pull-in) and hold coil winding 422'. Also shown in the cranking subsystem is the thermal switch 423, which is normally closed. Preferably, the thermal switch 423 opens at higher temperatures, but closes when the cranking subsystem 400' cools down. Other components of the cranking subsystem 400' are not depicted for clarity. However, there is no magnetic switch in the cranking subsystem 400'.

In the embodiment shown in FIG. 7, the PMM 100 replaces the magnetic switch 308 shown in FIG. 4. The embodiment shown in FIG. 7 also allows the single latch and hold coil winding 422' to replace the pull-in winding 302 and the hold-in winding 303 of the cranking subsystem 300 depicted in FIG. 4. Referring back to FIG. 7, when the start switch is closed, the controller 413' may close the switch 416'. The controller 413' may impose conditions other than the start switch being closed for the switch 416' to close. For example, the controller may only close the switch if there is a minimum voltage level of the battery 401 ' or a particular temperature of the switch 416' that is less than a particular level. When the switch 416' is closed, the positive terminal of the battery 401' is connected to the single latch and hold coil winding 422'. The single latch and hold coil winding 422' then pulls the front gear of the starter motor (not shown) to the engine's front gear (not shown) and holds the starter motor front gear in position. In a preferred embodiment, the power to the single latch and hold coil winding 422' is reduced when the starter motor's front gear is engaged with the engine's front gear. This is because it takes less power to hold the starter motor's front gear in place than to pull the front gear into place.

Based on certain criteria, the controller 413' may not close one or more of the switches 416'. Thus, no power will be provided to the cranking subsystem 400' and cranking will be prevented. Furthermore, based on some criteria, the controller 413' may open the switch 416', automatically disconnecting power to the cranking subsystem 400'. As a result, cranking will be stopped. The criteria used for refusing to close the switch 416' and the criteria used for opening the switch 416' may be programmed into the controller 413'. In a preferred embodiment, the criteria include providing a particular current to the cranking subsystem 400' for a particular amount of time; the temperature, voltage or current through the switch 416' exceeding particular thresholds, and the battery pack 401' having a voltage that is below a particular level. Also in a preferred embodiment, the PMM 100 will open the switch 416' when the behavior of the cranking subsystem 400' deviates from an expected behavior by a certain amount. Furthermore, the PMM 100 could control the switch 401' based on other criteria, such as signals input to the PMM 100 from the engine or other portion of the truck tractor.

Because the switch 416' control current to the single latch and hold coil winding 422', the hold-in winding 303 and the magnetic switch 308 shown in FIG. 4 may be eliminated. The magnetic switch 308 can be eliminated because the switch 416' controls power to the single latch and hold coil winding 422'. The hold-in windings 303 can be eliminated because the controller 413' controls the switch 416' to provide PWM. In other words, the controller 413' controls the switch 416' to open and close at a desired rate, which results in PWM. PWM steps down the power provided to the single latch and hold coil winding 422'. Thus, the single latch and hold coil winding 422' can be used to engage the starter motor's front gear, which requires a certain amount of power, and to hold the starter motor's front gear in place, which requires less power, without overheating. Once the single latch and hold coil winding 422' is energized and the starter motor's front gear in place, the main contacts (not shown) are closed automatically.

Because the single switch 412' is used in lieu of a magnetic switch, more components can be eliminated from the cranking subsystem 400'. The pull-in winding may be eliminated from the cranking subsystem 400'. Thus, the costs of the cranking subsystem 400' and the cost of the PMM 100 thus decrease.

It is also noted that the PMM 100, as used for overcranking protection in FIGS. 4–7, can also increase the chance of successful cranking during cold weather. This is accomplished by keeping minimums level of charges in the battery. Furthermore, the speed of engagement has an impact on starter life of the cranking subsystems 300, 400 and 400'. Conventional systems do not contain specific controls to regulate this speed. The PMM 100 here can regulate the speed through PWM of latch/hold coil, as discussed above.

PWM can also help prevent spikes. When a component like the cranking subsystem is started, the current drawn rises to a high spike is unregulated. The peak current could be four times the average current. This high current rush puts stress on the electrical system. The PMM 100 can limit the peak rush-in current by turning on and off the switches, in a manner similar to PWM. Thus, current spikes are reduced in magnitude.

Thus, the PMM can utilize its controller, switches, internal sensors or other components to function as an intelligent switch. Thus, the PMM can control power to the various portions of the device in which the PMM is used based on a variety of factors. In particular, the PMM can protect the cranking subsystem by determining whether to open or close switches coupling the power supply to the cranking subsystem based on certain criteria. As a result, performance of the power supply is improved, reliability of the power supply and other portions of the device are improved, and failures are reduced.

A method and system has been disclosed for an intelligent power management system. Although the present invention has been described in accordance with the embodiments shown, one of ordinary skill in the art will readily recognize that there could be variations to the embodiments and those variations would be within the spirit and scope of the present invention. Accordingly, many modifications may be made by one of ordinary skill in the art without departing from the spirit and scope of the appended claims.

What is claimed is:

1. A system for controlling power to a cranking subsystem in a device having a power source, the cranking subsystem coupled to an engine and a starter for allowing a user to activate the cranking subsystem, the system comprising:

a switch coupled between the power source and the cranking subsystem; and at least one controller, coupled with the switch, for controlling the switch to be open or closed based on the starter being used to activate the cranking subsystem and at least one other criteria, the at least one other criteria being programmed into the controller, the at least one other criteria including the cranking subsystem running for less than a particular time at a particular current, the controller opening the switch to cut off power to the cranking subsystem if greater than or equal to the particular current has flowed to the cranking subsystem through the switch for greater than or equal to the particular time.

2. The system of claim 1 wherein the at least one other criteria includes the power source having at least a particular power level.

3. The system of claim 1 wherein the at least one other criteria includes the switch having a temperature not exceeding a particular temperature.

4. The system of claim 1 wherein controller receives an input signal from the device, wherein the power source includes a battery, wherein the at least one other criteria includes the battery having at least a particular voltage and wherein the input signal indicates a voltage of the battery.

5. The system of claim 1 wherein controller receives an input signal from the device, wherein the at least one other criteria includes cranking subsystem running for less than a particular time at a particular current and wherein the input signal indicates a current through the cranking subsystem and a time for which the current has been provided.

6. The system of claim 1 further comprising:

an internal sensor for monitoring a property of the system and providing a signal to the controller; and wherein controller receives a signal from the internal sensor, the at least one criteria depending upon the signal from the internal sensor.

7. The system of claim 6 wherein the internal sensor further includes a temperature sensor and wherein the at least one criteria includes a temperature of the switch not exceeding a particular temperature.

8. The system of claim 1 wherein the cranking subsystem includes a starter motor and wherein the engine includes a front gear and wherein the switch cutting off the power to the cranking subsystem prevents the starter motor from being pulled and/or held to the front gear of the engine.

9. A method for controlling power to a cranking subsystem in a device having a power source, the cranking subsystem coupled to an engine and a starter for allowing a user to activate the cranking subsystem, the method comprising the steps of:

providing a switch coupled between the power source and the cranking subsystem; and providing at least one controller, coupled with the switch, for controlling the switch to be open or closed based on the starter being used to activate the cranking subsystem and at least one other criteria, the at least one other criteria being programmed into the controller, the at least one other criteria including the cranking subsystem running for less than a particular time at a particular current, the controller opening the switch to cut off power to the cranking subsystem if greater than or equal to the particular current has flowed to the cranking subsystem through the switch for greater than or equal to the particular time.

10. The method of claim 9 wherein the at least one other criteria includes the power source having at least a particular power level.

11. The method of claim 9 wherein the at least one other criteria includes the switch having a temperature not exceeding a particular temperature.

12. The method of claim 9 wherein controller receives an input signal from the device, wherein the power source includes a battery, wherein the at least one other criteria includes the battery having at least a particular voltage and wherein the input signal indicates a voltage of the battery.

13. The method of claim 9 wherein controller receives an input signal from the device, wherein the at least one other criteria includes cranking subsystem running for less than a particular time at a particular current and wherein the input signal indicates a current through the cranking subsystem and a time for which the current has been provided.

14. The method of claim 9 further comprising the step of:

providing an internal sensor for monitoring a property of the system and providing a signal to the controller; and wherein controller receives a signal from the internal sensor, the at least one criteria depending upon the signal from the internal sensor.

15. The method of claim 14 wherein the internal sensor further includes a temperature sensor and wherein the at least one criteria includes a temperature of the switch not exceeding a particular temperature.

16. The method of claim 9 wherein the cranking subsystem includes a starter motor and wherein the engine includes a front gear and wherein the switch cutting off the power to the cranking subsystem prevents the starter motor from being pulled and/or held to the front gear of the engine.

17. A method for controlling power to a cranking subsystem in a device having a power source, the cranking subsystem coupled to an engine and a starter for allowing a user to activate the cranking subsystem, the method comprising the steps of:

utilizing a switch and at least one controller to control power being provided to the cranking subsystem, the switch coupled between the power source and the cranking subsystem, the at least one controller coupled with the switch and controlling the switch to be open or closed based on the starter being used to activate the cranking subsystem and at least one other criteria, the at least one other criteria being programmed into the controller, the at least one other criteria including the cranking subsystem running for less than a particular time at a particular current, the controller opening the switch to cut off power to the cranking subsystem if greater than or equal to the particular current has flowed to the cranking subsystem through the switch for greater than or equal to the particular time.

18. The method of claim 17 wherein the at least one other criteria includes the power source having at least a particular power level.

19. The method of claim 17 wherein the at least one other criteria includes the switch having a temperature not exceeding a particular temperature.

20. The method of claim 17 wherein controller receives an input signal from the device, wherein the power source includes a battery, wherein the at least one other criteria includes the battery having at least a particular voltage and wherein the input signal indicates a voltage of the battery.

21. The method of claim 17 wherein controller receives an input signal from the device, wherein the at least one other criteria includes cranking subsystem running for less than a particular time at a particular current and wherein the input signal indicates a current through the cranking subsystem and a time for which the current has been provided.

22. The method of claim 17 wherein the cranking subsystem includes a starter motor and wherein the engine includes a front gear and wherein the switch cutting off the power to the cranking subsystem prevents the starter motor from being pulled and/or held to the front gear of the engine.

* * * * *